US010982525B2

(12) United States Patent
Zhan

(10) Patent No.: US 10,982,525 B2
(45) Date of Patent: Apr. 20, 2021

(54) DOWNHOLE DRILLING APPARATUS AND METHOD OF CONTROL THEREOF

(71) Applicants: China Petroleum & Chemical Corporation, Beijing (CN); Sinopec Tech Houston, LLC., Houston, TX (US)

(72) Inventor: Sheng Zhan, Houston, TX (US)

(73) Assignee: CHINA PETROLEUM & CHEMICAL CORPORATION, Beijing (CN)

( * ) Notice: Subject to any disclaimer, the term of this patent is extended or adjusted under 35 U.S.C. 154(b) by 216 days.

(21) Appl. No.: 16/208,331

(22) Filed: Dec. 3, 2018

(65) Prior Publication Data

US 2020/0173270 A1 Jun. 4, 2020

(51) Int. Cl.

| | |
|---|---|
| ***E21B 44/02*** | (2006.01) |
| ***E21B 47/12*** | (2012.01) |
| ***E21B 12/00*** | (2006.01) |
| ***E21B 3/02*** | (2006.01) |

(52) U.S. Cl.

CPC ..... *E21B 44/02* (2013.01); *E21B 3/02* (2013.01); *E21B 12/00* (2013.01); *E21B 47/12* (2013.01)

(58) Field of Classification Search

CPC . E21B 44/02; E21B 3/02; E21B 12/00; E21B 47/12

See application file for complete search history.

(56) References Cited

U.S. PATENT DOCUMENTS

| | | | | |
|---|---|---|---|---|
| 2012/0084065 | A1* | 4/2012 | Zhan | G06F 30/20 703/13 |
| 2013/0248247 | A1* | 9/2013 | Sugiura | G06F 19/00 175/24 |
| 2015/0345262 | A1* | 12/2015 | Kpetehoto | E21B 44/02 175/27 |
| 2017/0254190 | A1* | 9/2017 | Jones | E21B 44/005 |
| 2017/0370203 | A1* | 12/2017 | Hadi | E21B 4/02 |
| 2019/0078428 | A1* | 3/2019 | Fang | E21B 47/12 |

* cited by examiner

*Primary Examiner* — Yong-Suk (Philip) Ro

(74) *Attorney, Agent, or Firm* — Novick, Kim & Lee, PLLC; Allen Xue

(57) ABSTRACT

A downhole drilling system for reducing impact of vibration comprises a drill string having a bottom hole assembly (BHA) and a controller configured to control the downhole drilling system. The BHA includes a measurement sub configured to measure one or more of lateral, torsional, and axial vibrations. In this system, the controller controls the downhole drilling system based on a drilling environmental profile including drilling parameters of one or more of the lateral, torsional, and axial vibrations and further based on a vibration mode and a vibration level of the one or more of the lateral, torsional, and axial vibrations determined from the drilling environmental profile.

7 Claims, 6 Drawing Sheets

DOWNHOLE DRILLING APPARATUS AND METHOD OF CONTROL THEREOF

TECHNICAL FIELD

The present disclosure relates to drilling system, and more particularly, to a downhole drilling apparatus for creating boreholes in the earth's subsurface and its controlling method for reducing impact of vibration.

RELATED ART

Electronic parts that operate under downhole drilling conditions, such as printed circuit board assemblies (PCBAs) in Measurement-While-Drilling (MWD) or Logging-While-Drilling (LWD) tool, can experience a significant amount of vibration stresses over their lifetimes, which may induce failures during deployment.

Vibrations are extremely destructive and can seriously impact the drilling operations by increasing the nonproductive time due to tool failures or lowered drilling efficiency. Consequently, vibration monitoring and reduction is important for drilling optimization. Downhole vibrations alone or in combination with resonance can have a myriad of negative effects on the drilling operation, including poor drill bit performance, erratic downhole torque, excessive wear of drill string components, propagation of cracks in and on the body of the tools, failure of the electronic components in the MWD/LWD tool, and damage to the top drive and other rig equipment. In addition to these failures, severe vibrations can impact drilling efficiency by decreasing the rate of penetration (ROP) and reducing hole quality. All of these factors increase the total costs for both the operators, in the form of added rig time, and for the service companies, which would have to spend considerable financial resources for repair and maintenance.

Accordingly, it is desirable to have a drilling system that can be controlled in a manner to reduce the impact of the vibrations.

SUMMARY

The present disclosure provides the systems and methods for improving the reliability performance of the downhole drilling tools by reducing impacts of vibrations.

According to one embodiment of the present disclosure, a downhole drilling system for reducing impact of vibration is provided. The downhole drilling system comprises a drill string having a bottom hole assembly (BHA) disposed at a lower part thereof, a kelly drive configured to drive the drill string into a borehole, a top drive configured to rotate the drill string, and a controller configured to control the downhole drilling system. The BHA includes a drill bit disposed at an end portion of the BHA to break up the subsurface formation, a downhole motor having a stator and a rotor to operate the drill bit, and a measurement sub configured to measure one or more of lateral, torsional, and axial vibrations. In this embodiment, the controller controls the downhole drilling system based on a drilling environmental profile including drilling parameters of one or more of the lateral, torsional, and axial vibrations and further based on a vibration mode and a vibration level of the one or more of the lateral, torsional, and axial vibrations determined from the drilling environmental profile. By the controller, the vibration level is determined as one of predefined vibration stress levels that are categorized based on real time measurements of the one or more of the lateral, torsional, and axial vibrations. In a preferred embodiment, the real time measurements are transmitted to the controller via a communication protocol.

In one aspect of this embodiment, the measurement sub is a stand-alone device or is incorporated in Measurement-While-Drilling (MWD) tool and/or a Logging-While-Drilling (LWD) tool. Also, the measurement sub may include a plurality of probes to detect the one or more of the lateral, torsional, and axial vibrations. In detail, the plurality of the probes includes multiple probe sets disposed in or on an outer circumference surface of the measurement sub, each probe set having probes disposed horizontally, inclined upwards, or inclined downwards with respect to a cross section of the measurement sub. At least one of the plurality of the probes is configured to be extended or directionally changed by a probe motor or a hydraulic unit, and is made of a consumable material, a hard metal material, or a combination thereof. Further, at least one of the plurality of the probes has a tip portion having a mushroom shape or a hemispherical shape.

In another aspect of this embodiment, the vibration level of the lateral vibration is determined based on a measurement of the lateral vibration in a unit of g_RMS (gravitational acceleration_Root Mean Squared). The vibration level of the torsional vibration is determined based on parameters s_1 and s_2, wherein the parameter s_1 is a normalized difference between a minimum RPM and a maximum RPM detected over a measurement period as calculated by Equation 1: $s_1=(max_RPM-min_RPM)/(2\times Avg_RPM)$. Here, when the parameter s_1 is greater than or equal to 1.0 and less than or equal to 1.2, the controller determines that the vibration level of the torsional vibration corresponding to the amount of the parameter s_1, which indicates that the downhole drilling system is in a state of stick-slip. Also, when the parameter s_1 is greater than or equal to 0.4 and less than 1.0, the controller determines that the vibration level of the torsional vibration corresponding to the amount of the parameter s_1, which indicates that the downhole drilling system is in a state of torsional oscillation. Further, when the parameter s_1 is less than 0.4, the controller determines that the vibration level of the torsional vibration corresponding to the amount of the parameter s_1, which indicates that the downhole drilling system is in a normal state.

Moreover, if the parameter s_2 is a percentage of time in which the downhole drilling system rotates backward as a result of a stick-slip movement of the drill string, when the parameter s_2 is greater than 0.1, the controller determines that the vibration level of the torsional vibration corresponding to an amount of the parameter s_2, which indicates that the downhole drilling system is in a state of backward rotation. Lastly, the vibration level of the axial vibration is determined based on a measurement of the axial vibration in a unit of g_RMS (gravitational acceleration_Root Mean Squared).

In still another aspect of this embodiment, when the downhole drilling system is in the state of the stick-slip, the controller determines whether an origin of the stick-slip is bit-induced, drill string-induced, or a combination thereof based on the result of continuous rotation of the drill string after detaching the drill bit from the drill string. When the origin of the stick-slip is the drill string-induced, the controller instructs one or more of alleviating operations, which include increasing a rotary speed of one or more of the drill string and the drill bit to an RPM (rotation per minute) that overcomes stick-slip frictional forces and continuing drilling at a higher RPM; reaming the hole to reduce frictional resistance; adding lubricants to a drilling fluid; and adding a torque reduction sub in the drill string.

According to a further embodiment of the present disclosure, a method of controlling a downhole drilling system having a drill string, a drill bit and a measurement sub for reducing impact of vibration is provided. The method of controlling the downhole drilling system comprises receiving a drilling environmental profile including drilling parameters of one or more of the lateral, torsional, and axial vibrations, determining a vibration mode and a vibration level of the one or more of the lateral, torsional, and axial vibrations, determining a state of the torsional vibration based on the vibration level thereof when the vibration mode includes the torsional vibration, determining an origin of the state of the torsional vibration when the state of the torsional vibration includes stick-slip, and controlling the downhole drilling system based on one or more of the drilling environmental profile, the vibration mode, the vibration level, the state of the torsional vibration, and the origin of the state of the torsional vibration. In this embodiment, the measurement sub includes a plurality of probes that detect the one or more of the lateral, torsional, and axial vibrations, and wherein the controlling the downhole drilling system comprises extending a length of one or more of the plurality of the probes or changing a direction of one or more of the plurality of the probes.

In still other aspects of this embodiment, the vibration level is determined as one of predefined vibration stress levels which are categorized based on real time measurements of the one or more of the lateral, torsional, and axial vibrations. Also, the vibration level of the lateral vibration is determined based on a measurement of the lateral vibration in a unit of g_RMS (gravitational acceleration_Root Mean Squared). Further, the vibration level of the torsional vibration is determined based on parameters s_1 and s_2, wherein the parameter s_1 is a normalized difference between a minimum RPM and a maximum RPM detected over a measurement period as calculated by Equation 1: $S_1=(max_RPM-min_RPM)/(2\times Avg_RPM)$. In this embodiment, when the parameter s_1 is greater than or equal to 1.0 and less than or equal to 1.2, the state of the torsional vibration is determined as a state of stick-slip based on the vibration level of the torsional vibration corresponding to an amount of the parameter s_1. Also, when the parameter s_1 is greater than or equal to 0.4 and less than 1.0, the state of the torsional vibration is determined as a state of torsional oscillation based on the vibration level of the torsional vibration corresponding to an amount of the parameter s_1. Further, when the parameter s_1 is less than 0.4, the state of the torsional vibration is determined as a normal state based on the vibration level of the torsional vibration corresponding to an amount of the parameter s_1. Moreover, the parameter s_2 is a percentage of time in which the downhole drilling system rotates backward as a result of a stick-slip movement of the drill string. When the parameter s_2 is greater than 0.1, the state of the torsional vibration is determined as a state of backward rotation based on the vibration level of the torsional vibration corresponding to an amount of the parameter s_2. Lastly, the vibration level of the axial vibration is determined based on a measurement of the axial vibration in a unit of g_RMS (gravitational acceleration_Root Mean Squared).

In still another aspect of this embodiment, when the downhole drilling system is in the state of the stick-slip, the origin of the state of the stick-slip is determined as bit-induced, drill string-induced, or a combination thereof based on a result of continuous rotation of the drill string after detaching the drill bit from the drill string. If the origin of the stick-slip is the drill string-induced, the controlling the downhole drilling system includes instructing one or more of alleviating operations including increasing a rotary speed of one or more of the drill string and the drill bit to an RPM (rotation per minute) that overcomes stick-slip frictional forces and continuing drilling at a higher RPM; reaming the hole to reduce frictional resistance; adding lubricants to a drilling fluid; and adding a torque reduction sub in the drill string.

BRIEF DESCRIPTION OF THE DRAWINGS

The teachings of the present disclosure can be more readily understood by considering the following detailed description in conjunction with the accompanying drawings.

DETAILED DESCRIPTION

Figure 1:
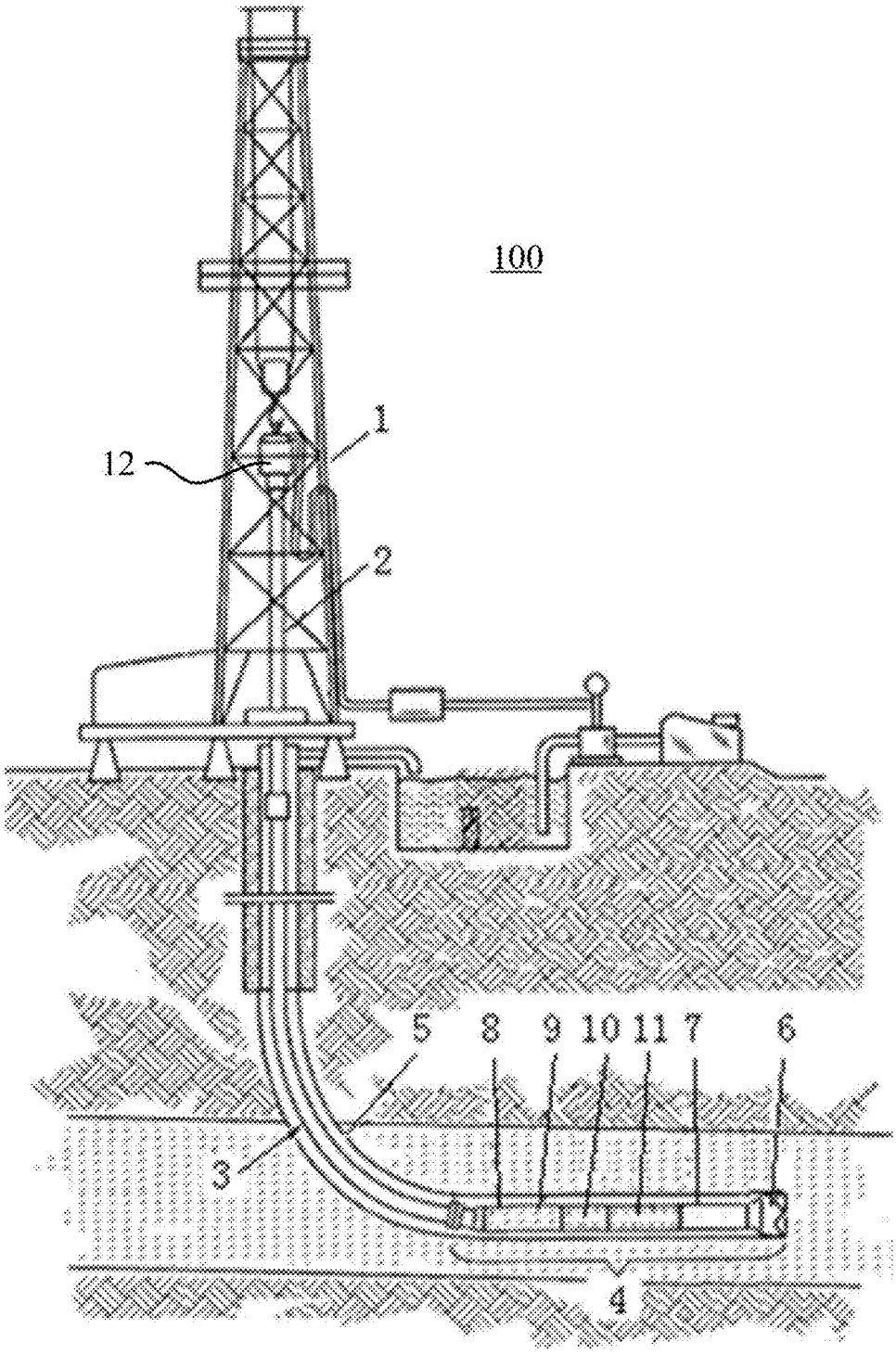
FIG. 1 is a schematic view illustrating a downhole drilling system according to one embodiment of the present disclosure.

Reference will now be made in detail to embodiments of the present disclosure, examples of which are illustrated in the accompanying drawings. It is noted that wherever practicable, similar or like reference numbers may be used in the drawings and may indicate similar or like elements.

The drawings depict embodiments of the present disclosure for purposes of illustration only. One skilled in the art would readily recognize from the following description that alternative embodiments exist without departing from the general principles of the present disclosure.

FIG. 1 is a schematic view illustrating a downhole drilling system according to one embodiment of the present disclosure.

The downhole drilling system 100 has a derrick 1 on the earth surface. A kelly drive 2 delivers a drill string 3 into a borehole 5. A lower part of the drill string 3 is a bottom hole assembly (BHA) 4, which includes a drill collar 8 with an MWD tool 9 installed therein, an LWD tool 10, a downhole motor 11, a measurement sub 7, and a drill bit 6. The drill bit 6 breaks up the earth formation in the borehole 5, and the downhole motor 11 having a stator and a rotor that rotate the drill bit 6. During a drilling operation, the downhole drilling system 100 may operate in a rotary mode, in which the drill string 3 is rotated from the surface either by a rotary table or a top drive 12 (or a swivel). The downhole drilling system 100 may also operate in a sliding mode, in which the drill string 3 is not rotated from the surface but is driven by the downhole motor 11 rotating the drill bit 6. Drilling mud is pumped from the earth surface through the drill string 3 to the drill bit 6, being injected into an annulus between the drill string 3 and a wall of the borehole 5. The drilling mud carries cuttings up from the borehole 5 to the surface.

The drill collar 8, which provides weight on the drill bit 6, has a package of instruments including the MWD tool 9 for measuring inclination, azimuth, well trajectory, etc. Also included in the drill collar 8 or at other locations in the drill string are the LWD tools 10 such as a neutron-porosity measurement tool and a density measurement tool, which are used to determined formation properties such as porosity and density. Those tools are electrically or wirelessly coupled together, powered by a battery pack or a power generator driven by the drilling mud. All information gathered is transmitted to the surface via a mud pulse telemetry system or through electromagnetic transmission.

In this embodiment, the measurement sub 7 is disposed between the downhole motor 11 and the drill bit 6, for measuring various modes of vibration as well as formation resistivity, gamma ray, and well trajectory. The data is transmitted through a cable embedded in the downhole motor 11 to the MWD tool 9 or other communication devices, or can be transmitted via a wireless communication protocol. The downhole motor 11 is connected to a bent housing that is adjustable at the surface. Due to the slight bend in the bent housing, the drill bit 6 can drill a curved trajectory.

Figure 2:
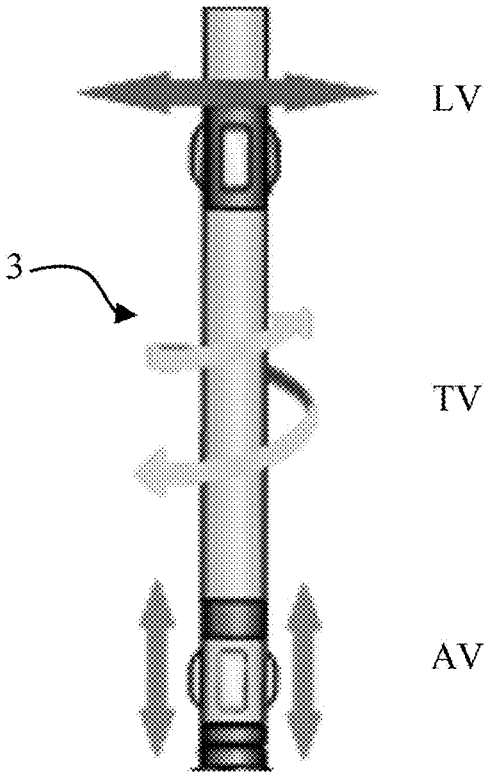
FIG. 2 shows three modes of downhole vibration measured at a drill string in the downhole drilling system of the present disclosure.

FIG. 2 shows three modes of downhole vibration measured at the drill string in the downhole drilling system of the present disclosure.

The drill string 3 is subjected to three modes of downhole vibrations: drill string axial vibration (AV), which occurs along the drill string axis; lateral vibration (LV), which occurs transverse to the drill string axis; and torsional vibration (TV), which occurs along a rotary path about the drill string axis. The data also may be transmitted in real time. The transmitted or recorded values of vibrations data is used to create a vibration environment profile.

Torsional vibration (TV), commonly referred to as stick-slip, is a phenomenon of alternating rotational acceleration and deceleration of the drill string 3. During the "stick" phase, the rotation of the drill bit 6 and/or the drill string 3 is stopped, while the "slip" phase occurs after sufficient torque has built up causing the drill string rotation to resume. The stick-slip is caused by the interaction of the BHA 4 and the borehole 5 and/or the interaction between the drill bit 6 and the formation that is being drilled. The stick-slip occurs most commonly when using polycrystalline diamond compact (PDC) bits with no depth of cut control, and often is formation-dependent due to changes in lithology. The drill string 3 is subject to two types of lateral vibrations (LV), which are transverse to the drilling axis. One of those is left/right lateral motions or off-center rotation, which is known as whirl. Laterals are the most damaging mode of vibration and require immediate control. Whirl, on the other hand, is a very stable phenomena and extremely difficult to mitigate. Since lateral vibrations are not transmitted easily up the drill string 3, they cannot be observed definitively at the surface. Conversely, axial vibrations are parallel to the drill string axis and are more common when drilling with tri-cone bits. The axial vibration (AV) can manifest as weight on bit (WOB) fluctuations and can be detected at surface. The axial vibrations can lead to bit damage, reduced ROP, top-drive damage and LWD/MWD failure.

Figure 3:
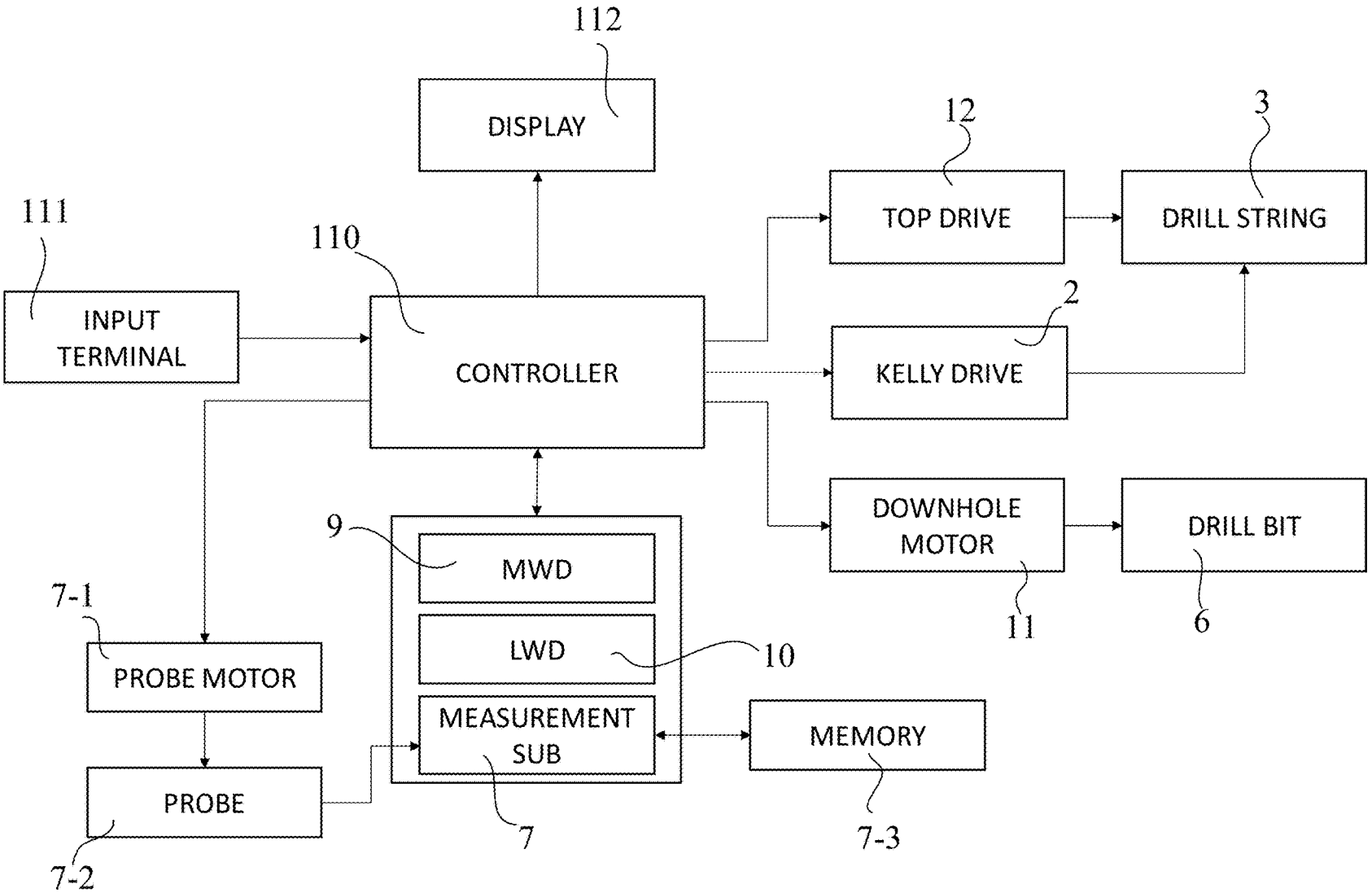
FIG. 3 is a schematic diagram illustrating a system for controlling the downhole drilling system according to one embodiment of the present disclosure.

FIG. 3 is a schematic diagram illustrating a system for controlling the downhole drilling system according to one embodiment of the present disclosure.

The downhole drilling system may further include a controller 110 which controls the downhole drilling system 100 based on a drilling environmental profile including drilling parameters of the lateral, torsional, and axial vibrations. Through data acquisition technologies according to this embodiment, the drilling environmental profile is captured by a plurality of probes 7-2 and recorded in memories 7-3 of a measurement sub 7, which can be incorporated into the MWD or LWD tool or independently installed as shown in FIGS. 1 and 3. Based on the drilling environmental profile, drilling vibration modes, vibration levels and loading conditions are retrieved and calculated to provide guidance to incorporate reliability into the borehole drilling processes.

Such drilling environmental profile may be shown on a display 112. Based on the vibration modes and vibration levels derived from the profile, the operator can give instructions via an input terminal 111 to control operational parts, such as the top drive 12, the kelly drive 2 and the downhole motor 11 of the downhole drilling system 100 in order to reduce negative impacts on the system due to the vibrations. This control also can be automatically conducted by the controller 110 without the operator's intervention. The vibration level is determined as one of predefined vibration stress levels which are categorized based on real time measurements of the lateral, torsional, and axial vibrations. In a preferred embodiment, the real time measurements are transmitted to the controller 110 via a wireless communication protocol.

Figure 4A:
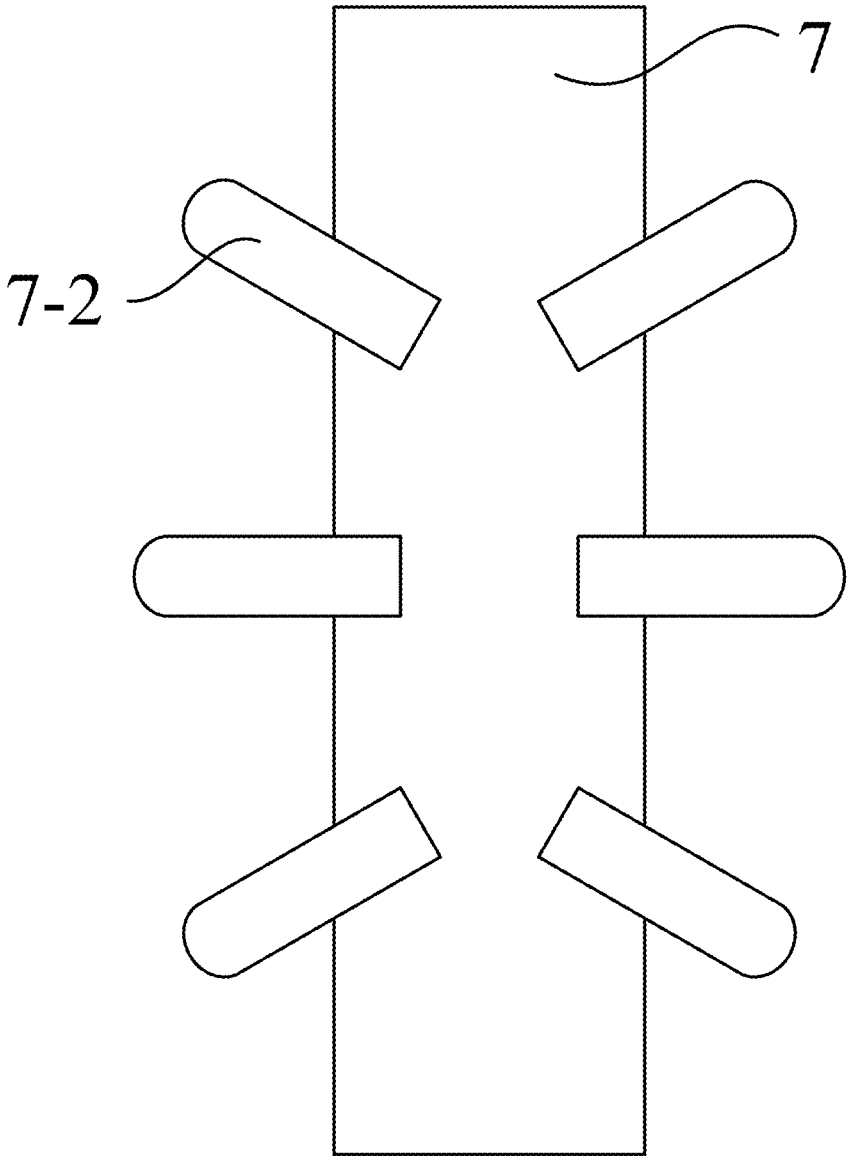
FIGS. 4A and 4B are respective schematic views of a side cross section and a top cross section of the vibration measurement sub in the downhole drilling system according to one embodiment of the present disclosure.
Figure 4B:
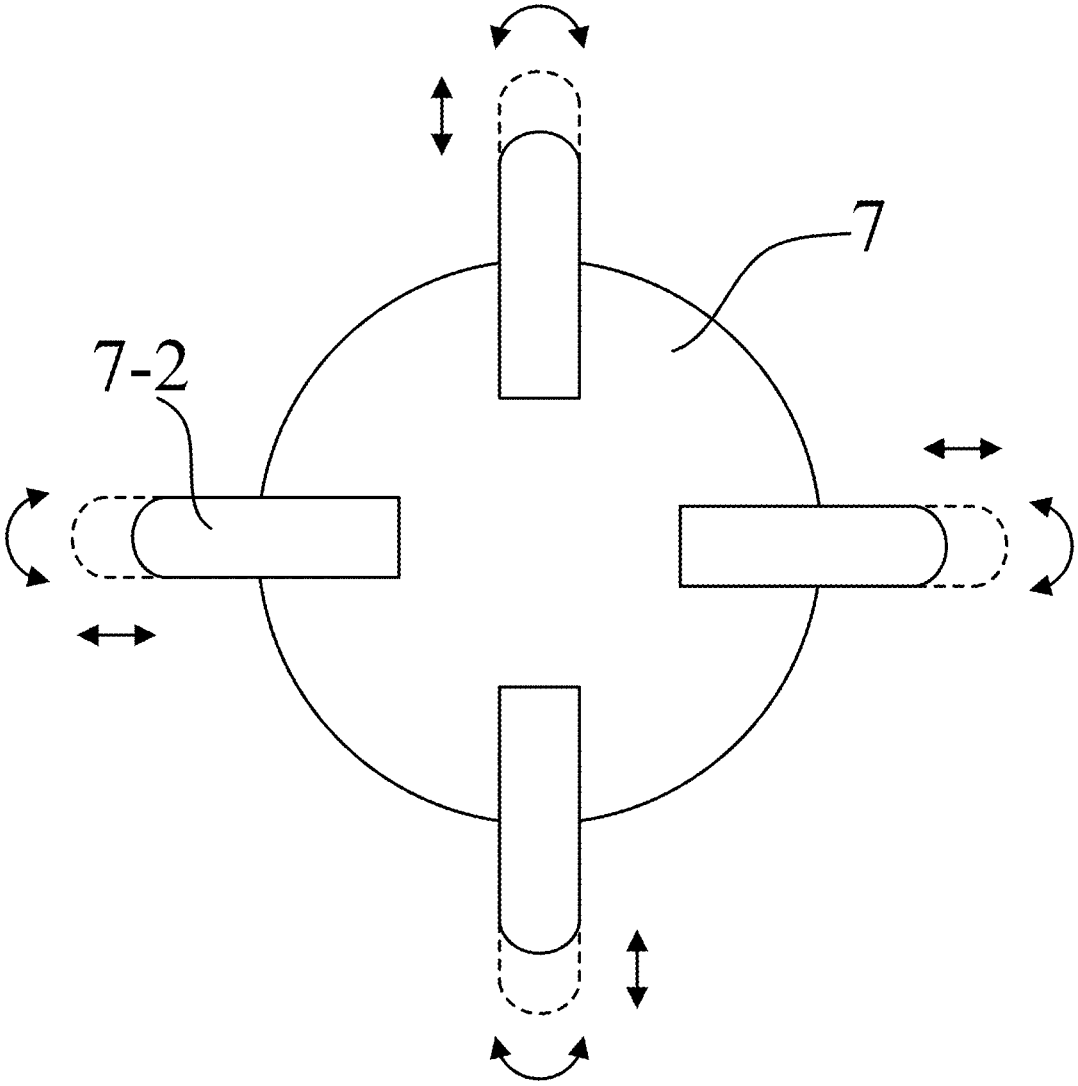

FIGS. 4A and 4B are respective schematic views of a side cross section and a top cross section of the vibration measurement sub in the downhole drilling system according to one embodiment of the present disclosure.

The measurement sub 7 includes a plurality of probes 7-2 that detect the lateral, torsional, and axial vibrations. As shown in FIGS. 4A and 4B, the plurality of the probes 7-2 may include four (4) probe sets disposed in or on an outer circumference surface of the measurement sub 7. Each probe set has three (3) probes, being 45 degree inclined upwards, horizontal and 45 degree inclined downwards with respect to a cross section of the measurement sub 7.

These probes 7-2 may be driven by either of a probe motor 7-1 (see FIG. 3) or by a hydraulic unit. Based on the vibration measurements, as shown in FIG. 4B, these probes 7-2 may be extended and/or pointed to the certain vector to erase or reduce the impact of the vibration. With the updated vibration measurements, the coordination of these 4 sets of the probe 7-2 may be adjusted their extended length to exert a force to impact the vector of the vibration force. These probes 7-2 may be made of consumable material or hard metal material, or a combination thereof. For the consumable material, a combination of rubber and epoxy compounds may be used to absorb vibration and shock when contacting the borehole. The hard metal material may act as a hard intervention during vibration. A tip portion of the probe 7-2 may have a mushroom shape or a hemispherical shape.

Figure 5:
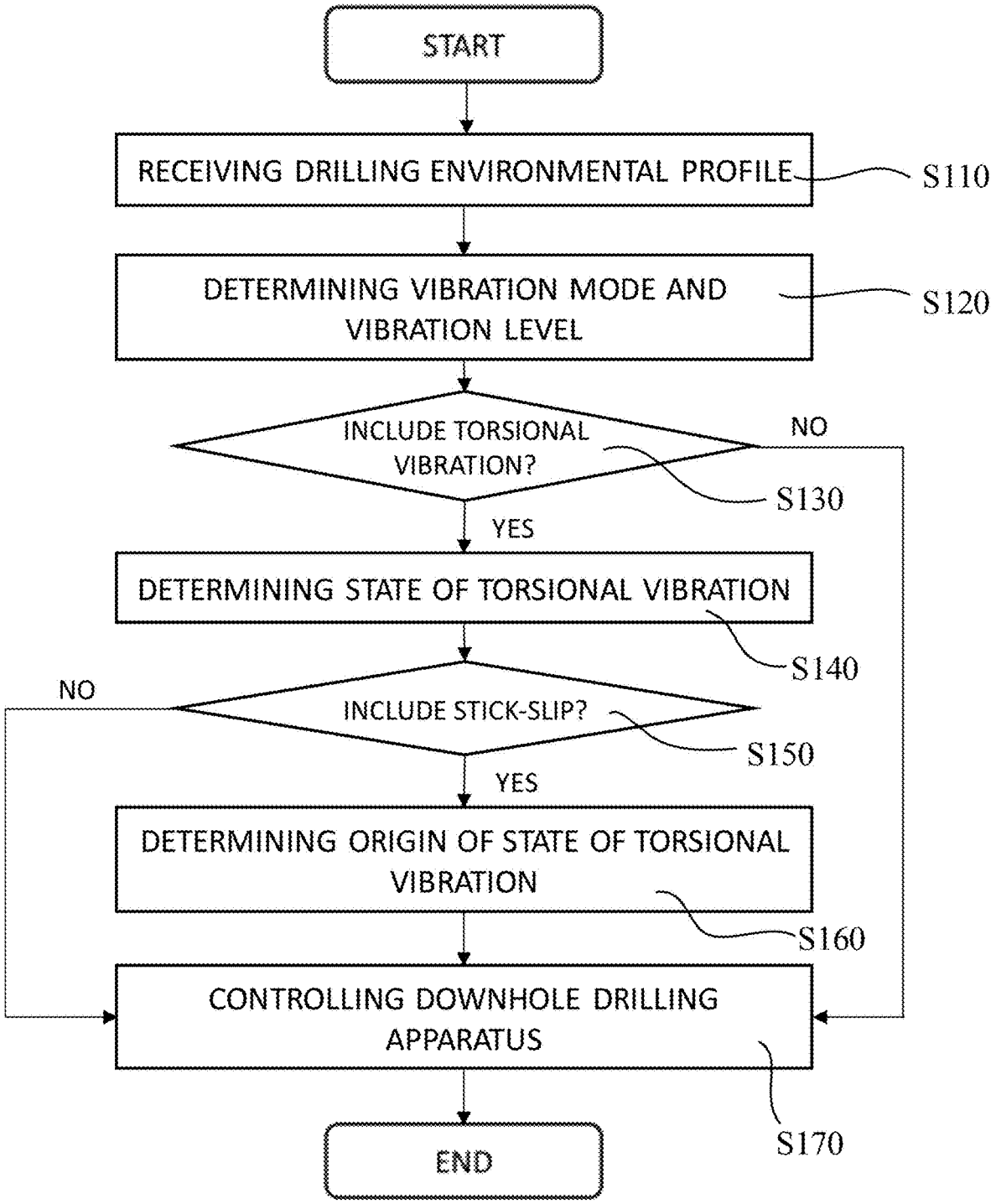
FIG. 5 is a flow chart showing a controlling method of the downhole drilling system according to one embodiment of the present disclosure.

FIG. 5 is a flow chart showing a controlling method of the downhole drilling system according to one embodiment of the present disclosure.

The drilling environmental profile includes a plurality of drilling parameters taken by various measurement tools, including the measurement sub 7. In this embodiment, the drilling environmental profile includes the drilling parameters of lateral vibration, axial vibration, torsional vibration (stick-slip) and temperature. As explained above, these lateral, axial, and torsional vibrations are measured by the measurement sub via the plurality of the probes installed therein. For each parameter, a stress due to a selected drilling parameter is categorized according to predefined stress levels. Exemplary drilling parameters and their exemplary stress levels are shown in Tables 1-4.

Table 1 shows an exemplary measurement table having predefined stress levels for lateral vibration measurements.

TABLE 1

| Lateral Vibration | |
|---|---|
| Level | Lateral Vibration (g_RMS) |
| 0 | $0.0 \leq x < 0.5$ |
| 1 | $0.5 \leq x < 1.0$ |
| 2 | $1.0 \leq x < 2.0$ |
| 3 | $2.0 \leq x < 3.0$ |
| 4 | $3.0 \leq x < 5.0$ |
| 5 | $5.0 \leq x < 8.0$ |
| 6 | $8.0 \leq x < 15.0$ |
| 7 | $15.0 \leq x$ |

Lateral vibration levels are defined from 0-7 and are derived from a range of a measurement (x) of lateral vibration in units of g_RMS (g_Root Mean Squared). Acceleration is often expressed in the unit "g," which is the Earth's natural gravitational acceleration (g is about 9.91 meters per second squared). The root mean squared (RMS) value of g gives an indication of both the mean and dispersion of a plurality of acceleration measurements and is indicative of the amount of detrimental energy experienced during a selected period of vibration. Thus, a measurement of 1.5 g_RMS for lateral vibration is recorded as a stress level 2. All time measurements are presented in hours to at least 2 decimal places.

Table 2 shows an exemplary measurement table having predefined stress levels for torsional vibration (stick-slip) measurements.

TABLE 2

| Torsional Vibration | | |
|---|---|---|
| Level | Torsional Vibration (g_RMS) | State of Vibration |
| 0 | $0.0 \leq s_1 < 0.2$ | Normal State |
| 1 | $0.2 \leq s_1 < 0.4$ | Normal State |
| 2 | $0.4 \leq s_1 < 0.6$ | Torsional Oscillations |
| 3 | $0.6 \leq s_1 < 0.8$ | Torsional Oscillations |
| 4 | $0.8 \leq s_1 < 1.0$ | Torsional Oscillations |
| 5 | $1.0 \leq s_1 < 1.2$ | Stick-Slip |
| 6 | $1.2 \leq s_1$ | Stick-Slip |
| 7 | $s_2 > 0.1$ | Backward Rotation |

Torsional Vibration levels are defined from 0-7 and are derived from the parameters s_1 and s_2, which are related to instantaneous RPM measurements of torsional vibration. The parameter s_1 is a normalized difference between minimum RPM and maximum RPM detected over a measurement period as shown in Equation 1:

$$s_1=(\max_RPM-\min_RPM)/(2\times Avg_RPM)$$

The parameter s_2 is a percentage of time in which the downhole tool rotates backward as a result of the stick-slip movement of the drill string. In this embodiment, the measurement period is 7.5 second, and all time measurements are presented in hours to at least 2 decimal places.

Table 3 shows an exemplary measurement table having predefined stress levels for axial vibration measurements.

TABLE 3

| Axial Vibration | |
|---|---|
| Level | Axial Vibration (g_RMS) |
| 0 | $0.0 \leq y < 0.5$ |
| 1 | $0.5 \leq y < 1.0$ |
| 2 | $1.0 \leq y < 2.0$ |
| 3 | $2.0 \leq y < 3.0$ |
| 4 | $3.0 \leq y < 5.0$ |
| 5 | $5.0 \leq y < 8.0$ |
| 6 | $8.0 \leq y < 15.0$ |
| 7 | $15.0 \leq y$ |

Axial vibration levels are also defined from 0-7 and are derived from a range of a measurement (y) of axial vibration in units of g_RMS (g_Root Mean Squared). The root mean squared (RMS) value of g gives an indication of both the mean and dispersion of a plurality of acceleration measurements and is indicative of the amount of detrimental energy experienced during a selected period of vibration. Thus, a measurement of 1.5 g_RMS for axial vibration is recorded as a stress level 2. All time measurements are presented in hours to at least 2 decimal places.

Referring to FIG. 5, the controlling method of the downhole drilling system 100 is initiated by receiving the drilling environmental profile including the drilling parameters of the lateral, torsional, and axial vibrations from the measurement sub (S110). Based on the drilling environmental profile, the controller 110 determines the vibration modes and the vibration levels of the lateral, torsional, and axial vibrations (S120). The vibration level of each vibration mode is derived from the different calculation as explained above.

If the vibration mode includes the torsional vibration, the controller 110 further determines the state of the torsional vibration based on its vibration level (S130 and S140). As shown in Table 2, if the parameter s_1 is greater than or equal to 1.0 and less than or equal to 1.2, the state of the torsional vibration is determined to be a state of stick-slip based on the vibration level (i.e., levels 5 and 6 in Table 2) of the torsional vibration. If the parameter s_1 is greater than or equal to 0.4 and less than 1.0, the state of the torsional vibration is determined to be a state of torsional oscillation based on the vibration level (i.e., levels 2-4) of the torsional vibration. If the parameter s_1 is less than 0.4, the state of the torsional vibration is determined to be a normal state based on the vibration level (i.e., levels 0 and 1) of the torsional vibration. Lastly, if the parameter s_2 is greater than 0.1, the state of the torsional vibration is determined to be a state of backward rotation based on the vibration level (i.e., level 7) of the torsional vibration.

The key for preventing or alleviating any mode of vibrations is to understand and identify the sources of the damaging vibrations and take preventative or mitigation measures to prevent or at best alleviate the conditions.

The first step in the prevention or mitigation of stick-slip is to identify whether the situation is bit-induced stick-slip (due to the interaction between the drill bit and the formation being drilled), drill string-induced stick-slip (interaction between the drill string and the borehole) or a combination thereof. Once that determination is made, remediation actions can be taken accordingly.

Thus, in this embodiment, if the state of the torsional vibration includes the stick-slip, the controller further determines an origin of the state of the torsional vibration (S150 and S160). Based on the drilling environmental profile, the vibration mode, the vibration level, the state of the torsional vibration, and the origin of the state of the torsional vibration, the controller 110 controls the downhole drilling system to reduce the impact of the vibrations (S170).

The primary test for determining the origin is to continue rotating the drill string 3 while the drill bit 6 is picked off the bottom of the drill string 3. For this, the controller 110 instructs the kelly drive 2 to drive back (lift) the drill string 3, after detaching the drill bit 6 from the drill string 3, and then instructs the top drive 12 to rotate the drill string 3 (see FIG. 3).

If the stick-slip stops when the drill bit 6 is picked off the bottom, the controller 110 can conclude it was bit-induced stick-slip. However, if the stick-slip does not change when the drill bit 6 is picked off the bottom, it is entirely the drill string-induced. On the other hand, if the stick-slip is still evident, but reduces in intensity after the drill bit 6 is picked off the bottom, the vibration is likely is a combination of both bit- and drill string-induced torsional vibration.

When the stick-slip occurs while drilling with a tri-cone bit, it usually is drill string-induced. The key for reducing or eliminating drill string-induced stick-slip is to lower the frictional resistance between the borehole wall and the drill string 3. Methods for alleviating drill string induced stick-slip include, but are not limited to: increasing the rotary speed of the drill string 3 to an RPM that overcomes the stick-slip frictional forces and continue drilling at the higher RPM, reaming the hole to improve drilling conditions, thereby reducing frictional resistance, adding lubricants to a drilling fluid, and adding torque reduction subs in the drill string 3.

If rig, borehole, or other limitations prevent any of the above from being accomplished, the alternative is to drill ahead at as low an RPM as possible, without compromising ROP or hole cleaning significantly. Lowering the RPM, in turn, lowers the torsional acceleration and deceleration forces, thus reducing the impact to the tool components when they transit from the stick to slip phase or vice versa.

While the bit-induced stick-slip is uncommon with tri-cone bits, it does occur and may be a warning that the cones or bearings should be evaluated carefully before drilling ahead. Bit-induced stick-slip is more common with aggressive PDC bits. While increasing the rotations per minute (RPM) and decreasing the WOB is the first defense for reducing the impact, sacrificing the high ROP realized with aggressive PDC bits means drilling may have to continue with high levels of stick-slip for short intervals. However, if the stick-slip persists, it can damage both the drill bit 6 and the drill string 3. Consequently, it may be prudent to use a less aggressive bit as one of the mitigation options. Stick-slip produced by the reactive torque of the mud motor, however, appears to be less damaging to drill string components. Hence, downhole conditions and ROP may improve by increasing the RPM of both the drill string and the mud motor.

Lateral vibration can be very destructive to BHA components and requires immediate attention. Lateral vibration is associated with whirl and bending of the drill string 3 and also with the resonant behavior at a critical rotary speed. Whirl is a stable phenomenon that can be identified with a decrease in ROP, an increase in vibration, a high steady torque, and the absence of stick-slip. Adjusting the WOB while slowing any increases in RPM to maximize the ROP could control the whirl.

Axial vibration is commonly caused by lithology changes or fractures as the drill bit 6 initiates a new cutting pattern. Axial vibration with a roller cone bit may indicate a bit or cone problem, while axial vibration with PDC bit may indicate bit balling or a severely worn cutting structure. On a high-quality PDC bit, increasing WOB and decreasing RPM should instigate torsional oscillation, which will help reduce the axial vibrations. If axial vibration persists, the drill bit 3 should be picked off bottom and a new drilling pattern should be re-established.

Embodiments of the present disclosure have been described in detail. Other embodiments will become apparent to those skilled in the art from consideration and practice of the present disclosure. Accordingly, it is intended that the specification and the drawings be considered as exemplary and explanatory only, with the true scope of the present disclosure being set forth in the following claims.

What is claimed is:

1. A method of controlling a downhole drilling system having a drill string, a drill bit, and a measurement sub for reducing impact of vibration, the method comprising:

receiving a drilling environmental profile including drilling parameters of one or more of lateral vibration, torsional vibration, or axial vibration;

determining a vibration mode and a vibration level of the one or more of the lateral vibration, the torsional vibration, or the axial vibration;

determining a state of the torsional vibration based on the vibration level thereof when the vibration mode includes the torsional vibration;

determining an origin of the state of the torsional vibration when the state of the torsional vibration includes stick-slip; and controlling the downhole drilling system based on one or more of the drilling environmental profile, the vibration mode, the vibration level, the state of the torsional vibration, and the origin of the state of the torsional vibrational, wherein the vibration level of the torsional vibration is determined based on parameters s_1 and s_2, wherein the parameter s_1 is a normalized difference between a minimum RPM and a maximum RPM detected over a measurement period, expressed as:

$$s_1=(\max_RPM-\min_RPM)/(2\times Avg_RPM);$$

wherein, when the parameter s_1 is greater than or equal to 1.0 and less than or equal to 1.2, determining the state of the torsional vibration to be a state of stick-slip based on the vibration level of the torsional vibration corresponding to an amount of the parameter s_1; when the downhole drilling system is in the state of the stick-slip, determining the origin of the state of the stick-slip as bit-induced, drill string-induced, or a combination thereof based on a result of continuous rotation of the drill string after detaching the drill bit from the drill string.

2. The method of claim 1, wherein the vibration level is determined as one of predefined vibration stress levels which are categorized based on real time measurements of the one or more of the lateral vibration, the torsional vibration, or the axial vibration.

3. The method of claim 2, wherein the measurement sub includes a plurality of probes to detect the one or more of the lateral vibration, the torsional vibration, or the axial vibration, and wherein the controlling the downhole drilling system comprises extending a length of one or more of the plurality of the probes or changing a direction of one or more of the plurality of the probes.

4. The method of claim 1, wherein, when the parameter s_1 is greater than or equal to 0.4 and less than 1.0, determining the state of the torsional vibration is to be a state of torsional oscillation based on the vibration level of the torsional vibration corresponding to an amount of the parameter s_1.

5. The method of claim 1, wherein, when the parameter s_1 is less than 0.4, determining the state of the torsional vibration to be a normal state based on the vibration level of the torsional vibration corresponding to an amount of the parameter s_1.

6. The method of claim 1, wherein the parameter s_2 is a percentage of time in which the downhole drilling system rotates backward as a result of a stick-slip movement of the drill string, and, when the parameter s_2 is greater than 0.1, determining the state of the torsional vibration to be a state of backward rotation based on the vibration level of the torsional vibration corresponding to an amount of the parameter s_2.

7. The method of claim 1, wherein, when the origin of the stick-slip is the drill string-induced, performing one or more actions chosen from increasing a rotary speed of one or more of the drill string and the drill bit to an RPM (rotation per minute) that overcomes stick-slip frictional forces and continuing drilling at a higher RPM, reaming the hole to reduce frictional resistance, adding lubricants to a drilling fluid, or adding a torque reduction sub in the drill string.

* * * * *